US010495089B2

(12) United States Patent
Fraser et al.

(10) Patent No.: US 10,495,089 B2
(45) Date of Patent: Dec. 3, 2019

(54) OIL EQUALIZATION CONFIGURATION FOR MULTIPLE COMPRESSOR SYSTEMS CONTAINING THREE OR MORE COMPRESSORS

(71) Applicants: Bruce A. Fraser, Manlius, NY (US); James William Bush, Skaneateles, NY (US)

(72) Inventors: Bruce A. Fraser, Manlius, NY (US); James William Bush, Skaneateles, NY (US)

(73) Assignee: Bitzer Kuehlmashinenbau GmbH, Sindelfingen (DE)

( * ) Notice: Subject to any disclaimer, the term of this patent is extended or adjusted under 35 U.S.C. 154(b) by 1496 days.

(21) Appl. No.: 13/950,488

(22) Filed: Jul. 25, 2013

(65) Prior Publication Data

US 2014/0037484 A1 Feb. 6, 2014

Related U.S. Application Data

(60) Provisional application No. 61/677,756, filed on Jul. 31, 2012.

(51) Int. Cl.
*F04C 29/02* (2006.01)
*F04C 18/02* (2006.01)
(Continued)

(52) U.S. Cl.
CPC ..... *F04C 29/028* (2013.01); *F04C 18/0215* (2013.01); *F04C 23/001* (2013.01);
(Continued)

(58) Field of Classification Search
CPC ..... F04C 29/02; F04C 29/021; F04C 29/028; F04C 28/02; F04C 23/00; F04C 23/001; F04C 23/003; F04C 2270/24; F16N 21/00
(Continued)

(56) References Cited

U.S. PATENT DOCUMENTS 3,360,958 A 1/1968 Miner
3,386,262 A 6/1968 Hackbart et al.
(Continued)

FOREIGN PATENT DOCUMENTS

EP 1 120 611 A1 8/2001
EP 1614983 A2 1/2006
(Continued)

OTHER PUBLICATIONS

U.S. Appl. No. 13/950,467, Fraser et al., filed Jul. 25, 2013.
U.S. Appl. No. 13/932,540, Fraser et al., filed Jul. 1, 2013.

*Primary Examiner* — Charles G Freay
(74) *Attorney, Agent, or Firm* — Reinhart Boerner Van Deuren P.C.

(57) ABSTRACT

A method of operating a refrigeration system having at least three compressors, in which each compressor has an oil sump with oil at an oil level. The method includes separately connecting the oil sumps of the at least three compressors. Each separate connection allows oil flow only between the oil sumps of two of said compressors thereby preventing bypass flow. The method further includes flowing oil between oil sumps of the at least three compressors and along the separate connections to tend to equalize the oil levels among the oil sumps of the at least three compressors.

14 Claims, 8 Drawing Sheets

(51) Int. Cl.
*F04C 23/00* (2006.01)
*F04C 28/02* (2006.01)

(52) U.S. Cl.
CPC ..... *F04C 23/008* (2013.01); *F04C 28/02* (2013.01); *F04C 29/021* (2013.01); *F04C 2270/24* (2013.01)

(58) Field of Classification Search
USPC ..... 417/228; 62/84, 192, 193, 468, 469, 510
See application file for complete search history.

(56) References Cited

U.S. PATENT DOCUMENTS

| | | | | |
|---|---|---|---|---|
| 3,581,519 | A | 6/1971 | Garrett, Jr. et al. | |
| 4,179,248 | A * | 12/1979 | Shaw | F04C 29/02 417/410.1 |
| 4,551,989 | A * | 11/1985 | Lindahl | F04B 39/0246 417/428 |
| 4,729,228 | A | 3/1988 | Johnsen | |
| 5,094,598 | A * | 3/1992 | Amata | F04B 39/0207 417/533 |
| 6,599,109 | B2 | 7/2003 | Zamudio et al. | |
| 6,736,607 | B2 | 5/2004 | Ginies et al. | |
| 6,983,622 | B2 * | 1/2006 | De Bernardi | F25B 31/002 184/6.16 |
| 7,137,265 | B2 * | 11/2006 | Kim | F25B 31/004 417/372 |
| 7,316,291 | B2 | 1/2008 | Thomsen et al. | |
| 7,421,850 | B2 | 9/2008 | Street et al. | |
| 7,721,757 | B2 | 5/2010 | Ginies et al. | |
| 8,079,830 | B2 | 12/2011 | Süss et al. | |
| 8,337,183 | B2 | 12/2012 | Milliff et al. | |
| 2001/0026766 | A1 | 10/2001 | Terai et al. | |
| 2005/0229627 | A1 | 10/2005 | De Bernardi et al. | |
| 2006/0059929 | A1 | 3/2006 | Sakitani et al. | |
| 2007/0074534 | A1 | 4/2007 | Sato | |
| 2009/0035168 | A1 | 2/2009 | Ginies et al. | |
| 2009/0041602 | A1 | 2/2009 | Ginies et al. | |
| 2009/0081062 | A1 | 3/2009 | Upadhye et al. | |
| 2010/0186433 | A1 | 7/2010 | Galante et al. | |
| 2010/0186439 | A1 | 7/2010 | Ogata et al. | |
| 2014/0037483 | A1 | 2/2014 | Fraser et al. | |

FOREIGN PATENT DOCUMENTS

| | | | |
|---|---|---|---|
| JP | 04287880 | A | 10/1992 |
| JP | 05071811 | A | 3/1993 |
| JP | H05272477 | A | 10/1993 |
| JP | 07035045 | A | 2/1995 |
| JP | H0829018 | A | 2/1996 |
| JP | H0861809 | A | 3/1996 |
| JP | 08128764 | A | 5/1996 |
| JP | 2605498 | B2 | 4/1997 |
| JP | 2001132645 | A | 5/2001 |
| JP | 2005076515 | A | 3/2005 |
| KR | 1020050065258 | A | 6/2005 |
| WO | WO 97/16647 | A1 | 5/1997 |
| WO | WO 2005/103492 | A1 | 11/2005 |
| WO | WO 2008/081093 | A2 | 7/2008 |

* cited by examiner

OIL EQUALIZATION CONFIGURATION FOR MULTIPLE COMPRESSOR SYSTEMS CONTAINING THREE OR MORE COMPRESSORS

CROSS-REFERENCE TO RELATED PATENT APPLICATIONS

This patent application claims the benefit of U.S. Provisional Patent Application No. 61/677,756 filed Jul. 31, 2012, the entire teachings and disclosure of which are incorporated herein by reference thereto.

FIELD OF THE INVENTION

This invention generally relates to multi-compressor refrigeration systems.

BACKGROUND OF THE INVENTION

A particular example of the state of the art with respect to suction gas distribution in a parallel compressor assembly is represented by WIPO patent publication WO2008/081093 (Device For Suction Gas Distribution In A Parallel Compressor Assembly, And Parallel Compressor Assembly), which shows a distribution device for suction gas in systems with two or more compressors, the teachings and disclosure of which is incorporated in its entirety herein by reference thereto. A particular example of oil management in systems having multiple compressors is disclosed in U.S. Pat. No. 4,729,228 (Suction Line Flow Stream Separator For Parallel Compressor Arrangements), the teachings and disclosure of which is incorporated in its entirety herein by reference thereto.

Embodiments of the invention described herein represent an advancement over the current state of the art. These and other advantages of the invention, as well as additional inventive features, will be apparent from the description of the invention provided herein.

BRIEF SUMMARY OF THE INVENTION

In one aspect, embodiments of the invention provide a method of operating a refrigeration system having at least three compressors, in which each compressor has an oil sump with oil at an oil level. The method includes separately connecting the oil sumps of the at least three compressors. Each separate connection allows oil flow only between the oil sumps of two of said compressors thereby preventing bypass flow. The method further includes flowing oil between oil sumps of the at least three compressors and along the separate connections to tend to equalize the oil levels among the oil sumps of the at least three compressors.

In a particular embodiment, the separate connections between the oil sumps of the at least three compressors are located at approximately the same vertical elevation, that is about equal to or minimally higher than the oil level of oil to thereby promote equalization of oil levels among the oil sumps. The method may further include connecting the oil sump of each compressor of a first group of the at least three compressors, each compressor of a first group having at least two separate connections, to oil sumps of other compressors of the at least three compressors. Additionally, the method may include connecting the oil sump of each compressor of a second group of the at least three compressors, each compressor of the second group having only a single separate connection, to the oil sump of one compressor of the first group. In certain embodiments, all of the compressors are in the first group and thereby have at least two separate connections. In other embodiments, each compressor of the first group has a housing shell, the housing shell having at least two separate oil sump ports having separate fittings connected thereto to provide the at least two separate connections.

In particular, the method may include extending the oil sump of at least one of the compressors of the first group with an oil sump extension to provide an internal oil sump, contained within a housing shell of the at least one of the compressors, and an external oil sump situated outside of the housing shell, wherein the oil sump extension has at least two separate connection ports to provide for said at least two separate connections. Certain embodiments call for connecting the oil sump of each compressor of a second group of the at least three compressors, each compressor in the second group having only a single separate connection, to the oil sump of one compressor of the first group, wherein only one compressor is provided in the first group that is connected separately to each compressor of the second group. In at least one embodiment, the second group includes at least three compressors.

The method may include extending the oil sump with an oil sump extension is done for at least two compressors, wherein each oil sump extension is coupled to two compressors other than the compressor to which the oil sump extension is attached. Embodiments of the invention may further include providing a sight glass fitting to provide a visual indication of the oil level integral with the oil sump extension.

In another aspect, embodiments of the invention provide a refrigeration system that includes at least three compressors connected in a fluid circuit. Each compressor has a compressor housing with an oil sump in a lower portion thereof. The oil sump is adapted to contain oil that defines an oil level when in a filled full oil state. The refrigeration system includes a supply line for supplying refrigerant, oil, and oil entrained in the refrigerant, to each of the at least three compressors. The oil sump of each compressor of the at least three compressors has at least one oil port in the lower portion. Each oil port is disposed at an elevation that is equal to or minimally higher than the oil level of oil to promote equalization of oil levels among the oil sumps. The refrigeration system also includes a plurality of separate conduits. Each oil port is connected to one of the conduits. Each conduit serves to connect respective oil sumps of pairs of compressors. The separate conduits are not directly connected to other conduits and are only fluidically connected through the oil sumps of the different compressors. In a particular embodiment, the at least three compressors comprise at least three scroll compressors connected in parallel.

In certain embodiments, each of the one or more openings on the at least three compressors are located at approximately the same vertical elevation above the bottom of its respective compressor housing. The refrigeration system may include a first group of the at least three compressors, wherein each of the compressors in the first group has two oil ports, and is connected via the two oil ports to two other compressors of the at least three compressors. The refrigeration system may have a second group of the least three compressors, wherein each of the compressors in the second group has one oil port, and is connected via the one oil port to another compressor of the at least three compressors.

In at least one embodiment, the first group has two compressors, and the second group has two compressors. In a further embodiment, one of the at least three compressors includes an oil sump extension having connections for the plurality of conduits, the oil sump extension configured to permit oil flow between oil sumps of compressors connected to the oil sump extension to promote equalization of the oil sump levels. In some embodiments, at least two of the at least three compressors include the oil sump extension, and the oil sump extension is configured to be connected to at least two compressors other than the one to which the oil sump extension is attached. In at least one embodiment, one of the at least three compressors has an oil sump extension connected to three other compressors of the at least three compressors.

Further, it is contemplated that embodiments of the invention include multi-compressor systems in which the individual compressors have different pumping capacities. The use of a plurality of compressors in a refrigeration system, where the individual compressors have different volume indexes is disclosed in U.S. Patent Publication No. 2010/0186433 (Scroll Compressors With Different Volume Indexes and Systems and Methods For Same), filed on Jan. 22, 2010, the teachings and disclosure of which is incorporated in its entirety herein by reference thereto.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The following detailed description describes embodiments of the invention as applied in a multi-compressor refrigeration system. However, one of ordinary skill in the art will recognize that the invention is not necessarily limited to refrigeration systems. Embodiments of the invention may also find use in other systems where multiple compressors are used to supply a flow of compressed gas.

Figure 1:
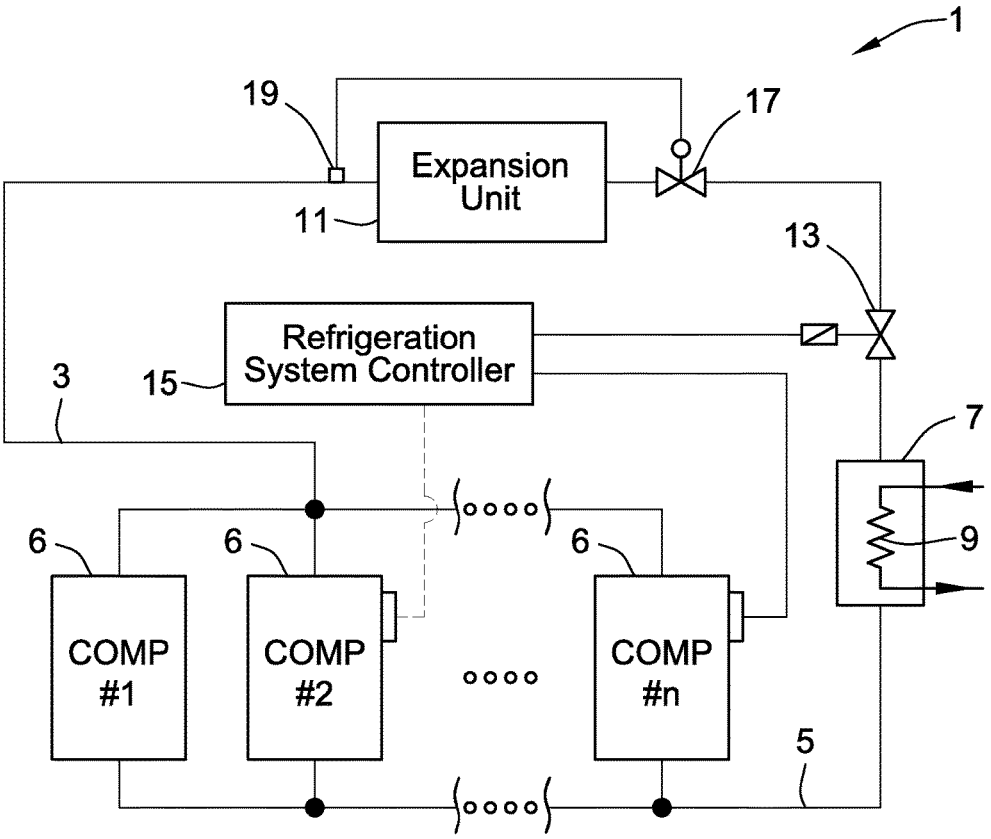
FIG. 1 is a block diagram of a multi-compressor refrigeration system, constructed in accordance with an embodiment of the invention.

FIG. 1 provides a schematic illustration of an exemplary multiple-compressor refrigeration system 1 having three or more compressors 6. As shown in FIG. 1, refrigeration system 1 has N compressors 6, where N is some number greater than or equal to three. The N compressors 6 of refrigeration system 1 are connected in a parallel circuit having inlet flow line 3 that supplies a flow of refrigerant to the N compressors 6, and outlet flow line 5 that carries compressed refrigerant away from the N compressors 6. In certain embodiments, the flow of refrigerant carries oil entrained within the flow, the oil used to lubricate moving parts of the compressor 6. As shown, the outlet flow line 5 supplies a condenser 7. In a particular embodiment, the condenser 7 includes a fluid flow heat exchanger 9 (e.g. air or a liquid coolant) which provides a flow across the condenser 7 to cool and thereby condense the compressed, high-pressure refrigerant.

An expansion unit 11 to provide cooling is also arranged in fluid series downstream of the condenser 7. In an alternate embodiment, the condenser 7 may feed multiple expansion units arranged in parallel. In the embodiment of FIG. 1, the expansion unit 11 includes an on/off stop valve 13, which, in some embodiments, is controlled by the refrigeration system controller 15 to allow for operation of the expansion unit 11 to produce cooling when necessitated by a demand load on the refrigeration system 1, or to preclude operation of the expansion unit 11 when there is no such demand. The refrigeration system controller 15 may also be directly connected to one or more of the N compressors 6. The expansion unit 11 also includes an expansion valve 17 that may be responsive to, or in part controlled by, a downstream pressure of the expansion unit 11, sensed at location 19. The expansion valve 17 is configured to control the discharge of refrigerant into the expansion unit 11, wherein due to the expansion, heat is absorbed to expand the refrigerant to a gaseous state thereby creating a cooling/refrigeration effect at the expansion unit 11. The expansion unit 11 returns the expanded refrigerant in a gaseous state along the inlet flow line 3 to the bank of N reciprocating compressors 6.

It should be noted that, for the sake of convenience, embodiments of the invention are frequently described hereinbelow with respect to their application in systems having multiple scroll compressors for compressing refrigerant. While particular advantages and configurations are shown for scroll compressor, some of these embodiments are not limited to scroll compressors, but may find use in a variety of compressors other than scroll compressors.

Figure 2:
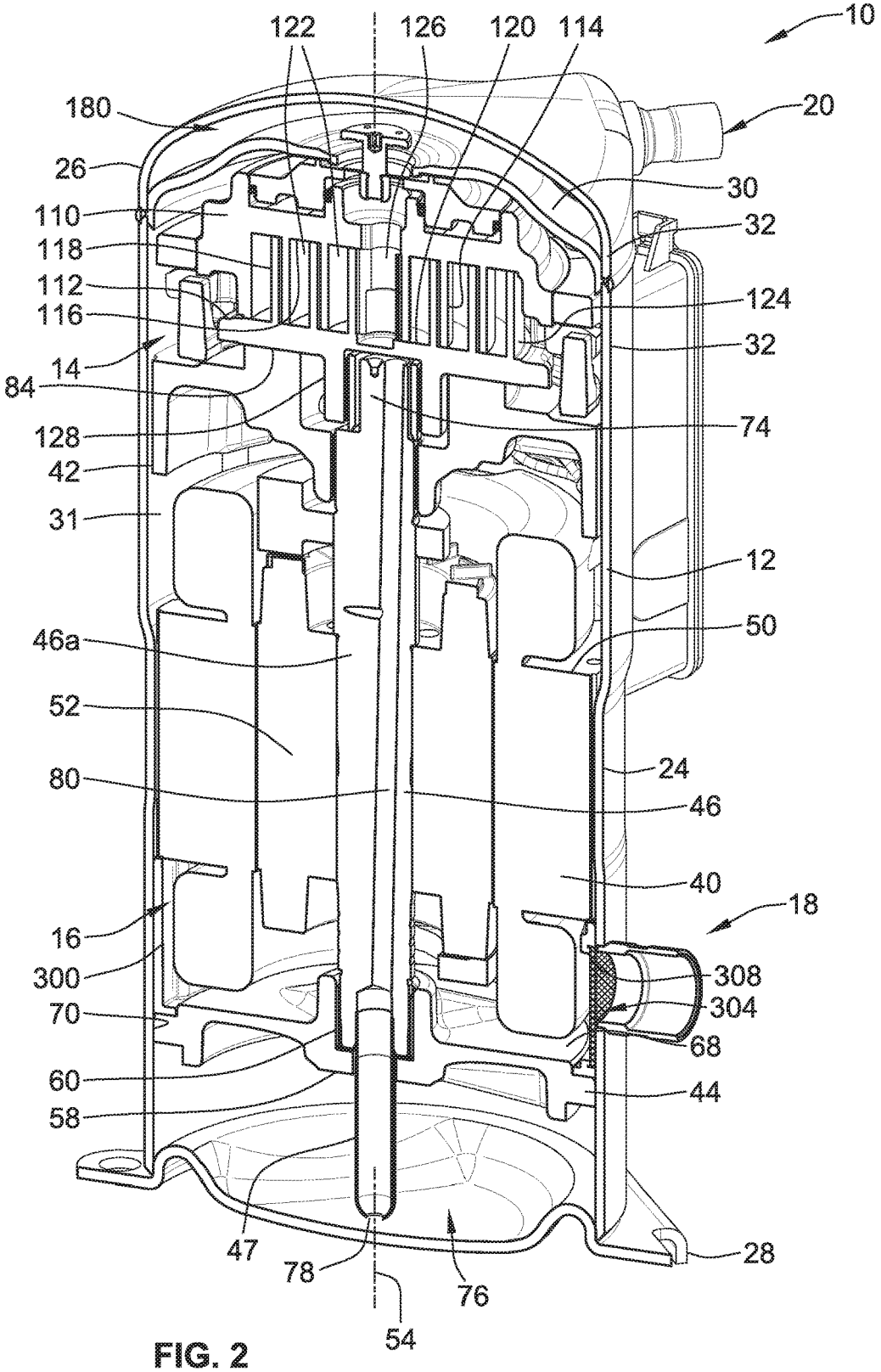
FIG. 2 is a cross-sectional view of a scroll compressor, constructed in accordance with an embodiment of the invention.

An embodiment of the present invention is illustrated in FIG. 2, which illustrates a cross-sectional view of a compressor assembly 10 generally including an outer housing 12 in which a compressor apparatus 14 can be driven by a drive unit 16. In the exemplary embodiments described below, the compressor apparatus 14 is a scroll compressor. Thus, the terms compressor apparatus and scroll compressor are, at times, used interchangeably herein. The compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The compressor assembly 10 is operable through operation of the drive unit 16 to operate the compressor apparatus 14 and thereby compress an appropriate refrigerant or other fluid that enters the refrigerant inlet port 18 and exits the refrigerant outlet port 20 in a compressed high pressure state.

The outer housing 12 may take various forms. In a particular embodiment, the outer housing 12 includes multiple housing or shell sections, and, in certain embodiments, the outer housing 12 has three shell sections that include a central housing section 24, a top end housing section 26 and a bottom end housing section, or base plate 28. In particular embodiments, the housing sections 24, 26, 28 are formed of appropriate sheet steel and welded together to make a permanent outer housing 12 enclosure. However, if disassembly of the outer housing 12 is desired, methods for attaching the housing sections 24, 26, 28 other than welding may be employed including, but not limited to, brazing, use of threaded fasteners or other suitable mechanical means for attaching sections of the outer housing 12.

The central housing section 24 is preferably tubular or cylindrical and may abut or telescopically fit with the top and bottom end housing sections 26, 28. As can be seen in the embodiments of FIG. 2, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. While the top end housing section 26 is generally dome-shaped and includes a cylindrical side wall region 32 to mate with the center housing section 24 and provide for closing off the top end of the outer housing 12, in particular embodiments, the bottom end housing section may be dome-shaped, cup-shaped, or substantially flat. As shown in FIG. 2, assembly of the outer housing 12 results in the formation of an enclosed chamber 31 that surrounds the drive unit 16, and partially surrounds the compressor apparatus 14.

In an exemplary embodiment of the invention in which a scroll compressor 14 is disposed within the outer housing 12, the scroll compressor 14 includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 which is typically arranged in the form of a spiral. Similarly, the movable scroll compressor body 112 includes a second scroll rib 118 projecting axially from a plate-like base 120 and is in the shape of a similar spiral. The scroll ribs 114, 118 engage with one another and abut sealingly on the respective surfaces of bases 120, 116 of the respectively other compressor body 112, 110.

In a particular embodiment of the invention, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via an adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearings 42, 44.

Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction along, or parallel to, the central axis 54, while the terms "radial' or "radially-extending" indicates a feature that projects or extends in a direction perpendicular to the central axis 54.

In particular embodiments, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

As can be seen in the embodiment of FIG. 2, the drive shaft 46 includes an impeller tube 47 attached at the bottom end of the drive shaft 46. In a particular embodiment, the impeller tube 47 is of a smaller diameter than the drive shaft 46, and is aligned concentrically with the central axis 54. The drive shaft 46 and impeller tube 47 pass through an opening in the cylindrical hub 58 of the lower bearing member 44. The impeller tube 47 has an oil lubricant passage and inlet port 78 formed at the end of the impeller tube 47.

At its upper end, the drive shaft 46 is journaled for rotation within the upper bearing member 42. Hereinafter, the upper bearing member 42 is also referred to as a "crankcase". In particular embodiments, the drive shaft 46 further includes an offset eccentric drive section 74 which typically has a cylindrical drive surface about an offset axis that is offset relative to the central axis 54. This offset drive section 74 may be journaled within a central hub 128 of the movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which a suitable amount of oil lubricant may be stored.

It can also be seen that FIG. 2 shows an embodiment of a suction duct 300 in use in scroll compressor assembly 10. In certain embodiments, the suction duct 300 comprises a plastic molded ring body that is situated in a flow path through the refrigerant inlet port 18 and in surrounding relation of the motor 40. The suction duct 300 is arranged to direct and guide refrigerant into the motor cavity for cooling the motor 40 while at the same time filtering out contaminants and directing lubricating oil around the periphery of the suction duct 300 to the oil sump 76.

Additionally, in particular embodiments, the suction duct 300 includes a screen 308 in the opening 304 that filters refrigerant gas as it enters the compressor through the inlet port 18, as illustrated in FIG. 2. The screen 308 is typically made of metal wire mesh, such as a stainless steel mesh, in which the individual pore size of the screen 308 typically ranges from 0.5 to 1.5 millimeters.

As shown in FIG. 2 and as mentioned above, the suction duct 300 is positioned in surrounding relation to the motor 40, and, in some embodiments, includes a generally arcuate outer surface that is in surface to surface contact with the inner surface of the generally cylindrical outer housing 12. In particular embodiments, the suction duct 300 includes a sealing face that forms a substantial seal between the outer housing 12 and the suction duct 300. The sealing face can surround and seal the opening 304 to ensure that refrigerant flows into the motor cavity. The seal may be air tight, but is not required to be. This typically will ensure that more than 90% of refrigerant gas passes through the screen 308 and preferably at least 99% of refrigerant gas. By having a seal between the sealing face 316 and the portion of the housing outer 12 surrounding the inlet port 18, the suction duct 300 can filter large particles from the refrigerant gas that enters through the inlet port 18, thus preventing unfiltered refrigerant gas from penetrating into the compressor, and can direct the cooling refrigerant into the motor cavity for better cooling of the motor 40 while directing oil down to oil sump 76.

During operation, the refrigerant gas flowing into the inlet port 18 is cooler than compressed refrigerant gas at the outlet port 20. Further, during operation of the scroll compressor 14, the temperature of the motor 40 will rise. Therefore, it is desirable to cool the motor 40 during operation of the compressor. To accomplish this, cool refrigerant gas that is drawn into the compressor outer housing 12 via inlet port 18 flows upward through and along the motor 40 in order to reach the scroll compressor 14, thereby cooling the motor 40.

Furthermore, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be required.

Figure 3:
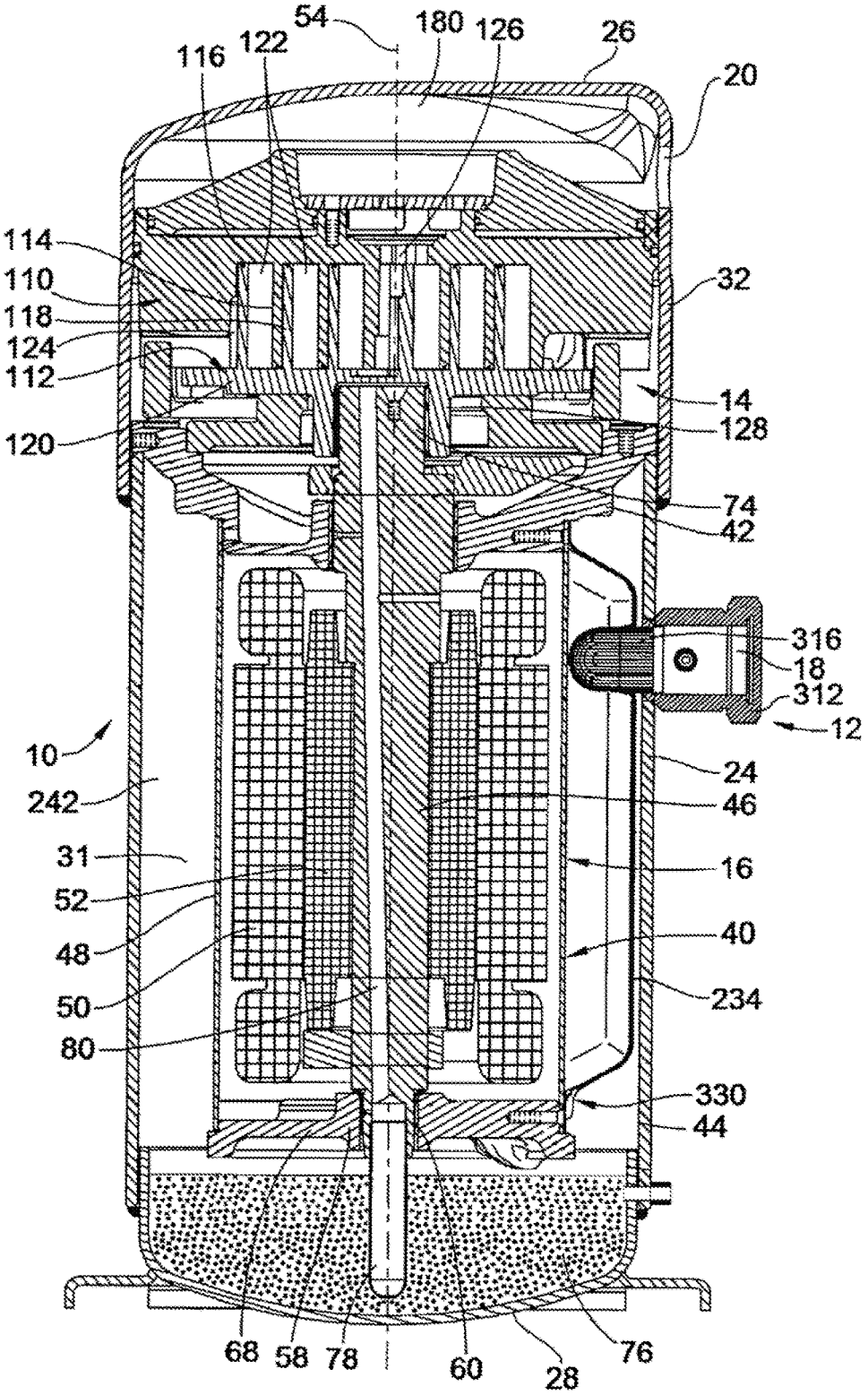
FIG. 3 is a cross-sectional view of a scroll compressor, constructed in accordance with an alternate embodiment of the invention.
Figure 4:
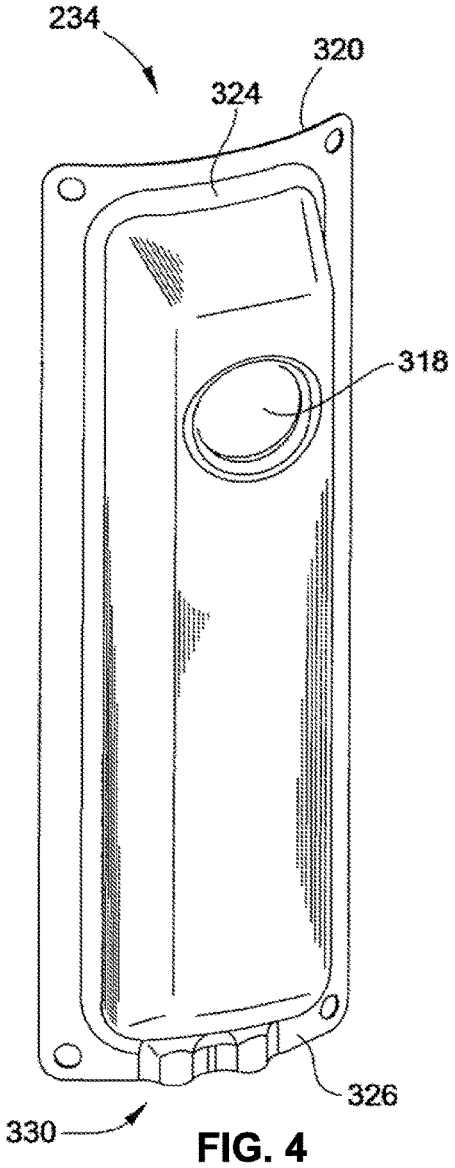
FIG. 4 is a perspective front view of a suction duct, constructed in accordance with an embodiment of the invention.
Figure 5:
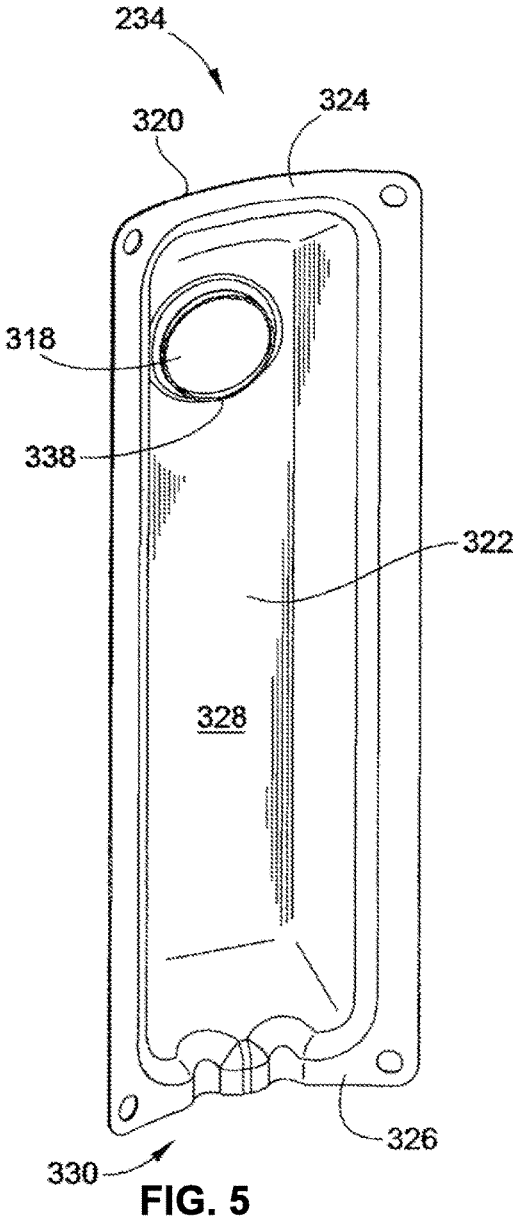
FIG. 5 is a perspective rear view of the suction duct of FIG. 4.

FIG. 3 illustrates a cross-sectional view of an alternate embodiment of a compressor assembly 10. In FIG. 3, it can be seen that a suction duct 234 may be employed to direct incoming fluid flow (e.g. refrigerant) through the housing inlet port 18. To provide for the inlet port 18, the outer housing 12 includes an inlet opening in which resides an inlet fitting 312. In a particular embodiment shown in FIGS. 4 and 5, the suction duct 234 comprises a stamped sheet steel metal body having a constant wall thickness with an outer generally rectangular and arcuate mounting flange 320 which surrounds a duct channel 322 that extends between a top end 324 and a bottom end 326. The entrance opening and port 318 is formed through a channel bottom 328 proximate the top end 324. This opening and port 318 provide means for communicating and receiving fluid from the inlet port 18 via a suction screen flange 316 (shown in FIG. 3) which is received through the outer housing wall of the compressor and into duct channel 322 of the suction duct 234. The entrance opening and port 318 includes an annular opening flange 338 that surrounds the entrance opening and port 318.

A duct channel provides a fluid flow path to a drain port 330 at or near the bottom end 326 of the suction duct 234. In this embodiment, the drain port 330 extends through the bottom end 326 and thereby provides a port for draining lubricant oil into the lubricant oil sump 76, and also to communicate substantially the entire flow of refrigerant for compression to a location just upstream of the motor housing.

Not only does the suction duct 234 direct refrigerant and substantially the entire flow of refrigerant from the inlet port 18 to a location upstream of the motor 40 and to direct fluid flow through the motor 40, but it also acts as a gravitational drain preferably by being at the absolute gravitational bottom of the suction duct 234 or proximate thereto so as to drain lubricant received in the suction duct 234 into the lubricant oil sump 76. This can be advantageous for several reasons. First, when it is desirable to fill the lubricant oil sump 76 either at initial starting or otherwise, oil can readily be added through the inlet port 18, which acts also as an oil fill port so that oil will naturally drain through the suction duct 234 and into the oil sump 76 through the drain port 330. The outer housing 12 can thereby be free of a separate oil port. Additionally, the surfaces of the suction duct 234 and redirection of oil therein causes coalescing of oil lubricant mist, which can then collect within the duct channel 322 and drain through the drain port 330 back into the oil sump 76. Thus, direction of refrigerant as well as direction of lubricant oil is achieved with the suction duct 234.

During operation, the scroll compressor assemblies 10 are operable to receive low pressure refrigerant at the housing inlet port 18 and compress the refrigerant for delivery to a high pressure chamber 180 where it can be output through the housing outlet port 20. As is shown, in FIGS. 2 and 3, the suction duct 234, 300 may be disposed internally of the outer housing 12 to guide the lower pressure refrigerant from the inlet port 18 into outer housing 12 and beneath the motor housing. This allows the low-pressure refrigerant to flow through and across the motor 40, and thereby cool and carry heat away from the motor 40. Low-pressure refrigerant can then pass longitudinally through the motor housing 48 and around through void spaces therein toward the top end of the motor housing 48 where it can exit through a plurality of motor housing outlets in the motor housing 48 (shown in FIG. 3), or in the upper bearing member 42. Upon exiting the motor housing outlet, the low-pressure refrigerant enters an annular chamber 242 (shown in FIG. 3) formed between the motor housing 48 and the outer housing 12. From there, the low-pressure refrigerant can pass by or through the upper bearing member 42.

Upon passing through the upper bearing member 42, the low pressure refrigerant finally enters an intake area 124 of the scroll compressor bodies 110, 112. From the intake area 124, the lower pressure refrigerant is progressively compressed through chambers 122 to where it reaches its maximum compressed state at a compression outlet 126 where it subsequently passes through a check valve and into the high pressure chamber 180. From there, high-pressure compressed refrigerant may then pass from the scroll compressor assembly 10 through the outlet port 20.

FIGS. 6-11 are schematic diagrams showing various embodiments of refrigeration systems consistent with the system shown in FIG. 1. In particular embodiments of the invention, the compressors 202 depicted in FIGS. 6-11 are scroll compressors of the type shown in FIG. 2 or 3. However, in alternate embodiments of the invention, compressors other than scroll compressors may be used. As will be explained in more detail below, the compressors 202 of FIGS. 6-11 includes a compressor housing with an oil sump located in a lower portion of the compressor housing. The oil sump is configured to hold oil at an oil level for the lubricating of moving parts in the compressor.

Figure 6:
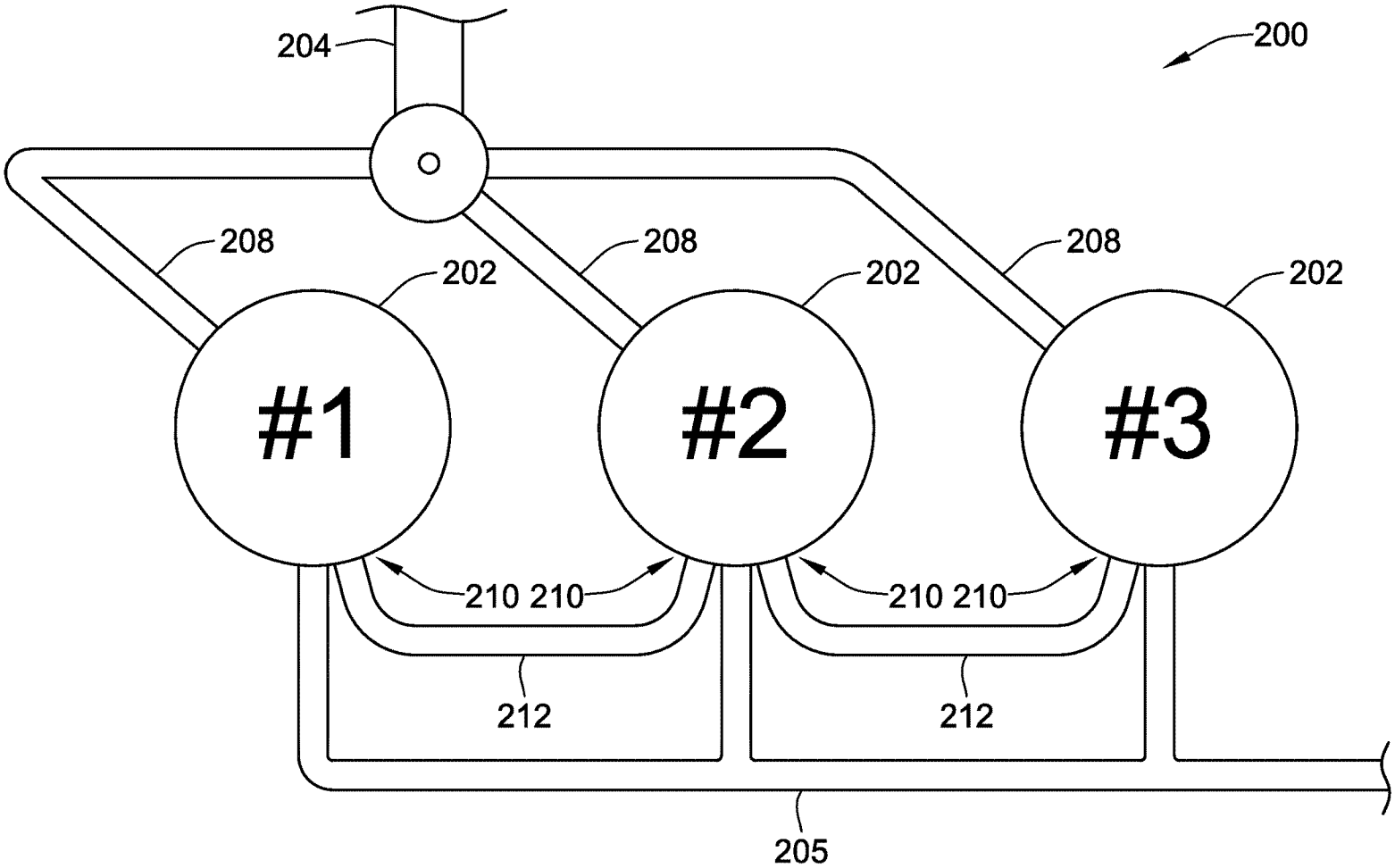
FIG. 6 is a schematic diagram of a three-compressor refrigeration system, constructed in accordance with an embodiment of the invention.

In the refrigeration system 200 of FIG. 6, compressors #1, #2, and #3 202 are connected in parallel. When any of these compressors 202 is shut off and there is no flow restriction, the oil sump 76 pressure will be relatively higher than a running compressor with the same suction inlet pressure. This pressure differential between the oil sump 76 of a running compressor and the oil sump 76 of an off compressor allows for oil distribution from the off compressor to the running compressors in the refrigeration system 200.

While all three compressors 202 receive a flow of refrigerant from a suction header, also referred to herein as a common supply line 204, and discharge refrigerant to a common discharge or outlet line 205, in particular embodiments, the common supply line 204 is configured to deliver more lubricating oil to compressor #2 202 than to the remaining compressors #1 and #3 202. This may be accomplished by the piping configuration, or, alternatively, by placing an oil separator (not shown) in the common supply line 204. In particular embodiments, the common supply line 204 feeds an inlet supply line 208 for each of the compressors 202 in the refrigeration system. In a further embodiment, the supply line to compressor #2 202 is designed to have less restriction than the supply lines to compressors #1 and #3 202, when compressors #1 and #3 202 are running.

In FIGS. 6-11, each of the compressors 202 shown has one or more openings, or oil ports, 210 in a lower portion of the compressor housing. As will be described below, the opening 210 may have a fitting attached thereto, the fitting configured to accommodate a conduit 212 or an oil sump extension 214. In the embodiment of FIG. 6, compressor #2 202 has two openings 210, while compressors #1 and #3 each has one opening 210. Two conduits 212 provide separate connections between a first pair of compressors #1 and #2 202, and a second pair of compressors #2 and #3 202. In a particular embodiment, all of the openings 210 on the three compressors 202 are at approximately the same height or vertical elevation with respect to the bottom of the compressor housing, or the bottom of the oil sump. Positioning the openings 210 in this manner promotes equalization of the oil levels in the three compressors 202.

Figure 7:
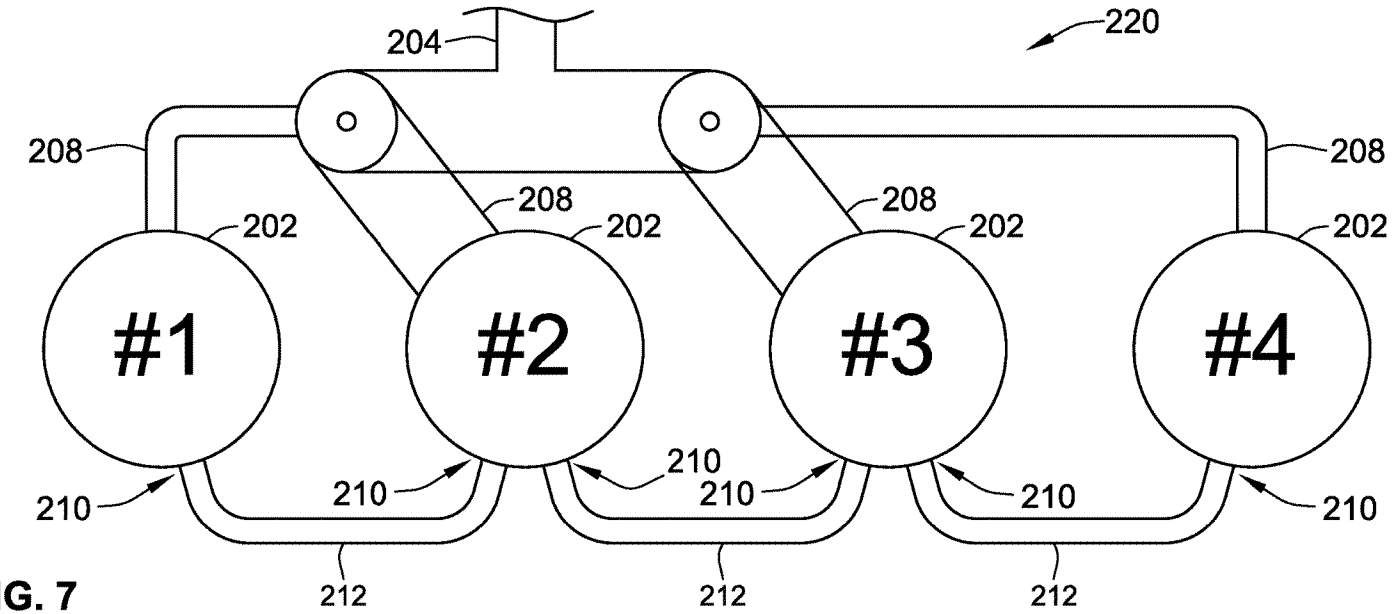
FIG. 7 is a schematic diagram of a four-compressor refrigeration system, constructed in accordance with an embodiment of the invention.

FIG. 7 is a schematic diagram illustrating a multi-compressor refrigeration system 220 arranged similarly to the refrigeration system 200 of FIG. 6, except that refrigeration system 220 has four compressors 202. Like the system of FIG. 6, a particular embodiment of refrigeration system 220 includes the common supply line 204 that, in this case, feeds four inlet supply lines 208 that connect to the inlets of the four compressors 202. Compressors #2 and #3 202 each have two oil ports or openings 210, while compressors #1 and #4 202 each have one opening 210. In certain embodiments, more oil may be returned, through the common supply line 204 and input supply lines 208, to compressors #2 and #3 202 than is returned to compressors #1 and #4 202. Three separate conduits 212 provide separate connections between a first pair of compressors #1 and #2 202, a second pair of compressors #2 and #3 202, and a third pair of compressors #3 and #4 202. As can be seen in FIG. 7, each of compressors #2 and #3 202 can draw oil from, or supply oil to, their respective two adjacent compressors 202, while compressors #1 and #4 202 draw oil from, or supply oil to one adjacent compressor 202. As in the embodiment described above, in certain embodiments, the various openings 210 are at the same vertical elevation to promote equalization of the oil level in the four compressors 202.

Figure 8:
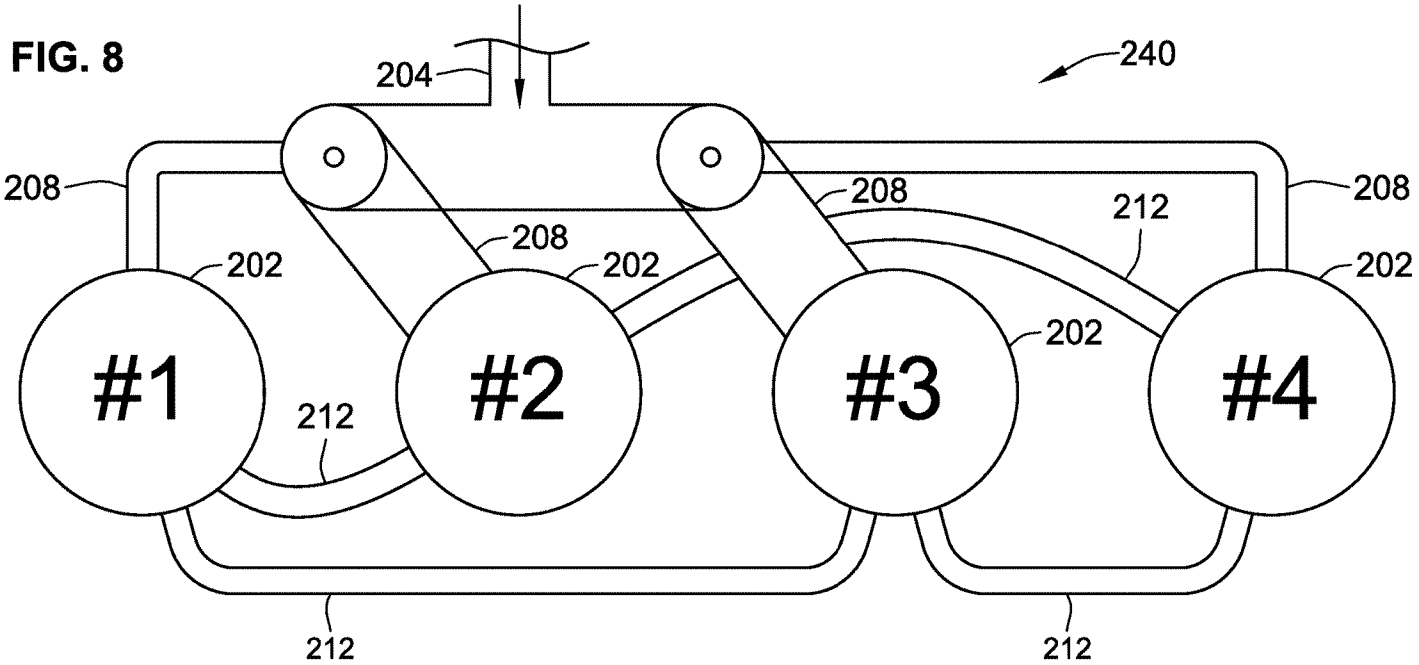
FIG. 8 is a schematic diagram of a four-compressor refrigeration system, constructed in accordance with an alternate embodiment of the invention.

FIG. 8 is a schematic diagram illustrating a four-compressor refrigeration system 240 in which all four compressors 202 have two oil ports or openings 210 (shown in FIGS. 7 and 9-11). Some embodiments of the invention include the common supply line 204 connected to four inlet supply lines 208 that connect to the inlets of the four compressors 202. Four separate conduits 212 provide separate connections between four pairs of the compressors 202. In this embodiment, each of the four compressors 202 can draw oil from, or supply oil to, two other compressors 202. In the arrangement shown, compressors #2 and #3 202 are each coupled, via conduits 212, to compressors #1 and #4 202. Table 1, shown below, describes how return oil flows into refrigeration system 240, and how this oil is distributed between the four compressors 202. In a particular embodiment, the common supply line 204 and the four inlet supply lines 208 are configured such that the primary flow of circulating oil is supplied to compressors #2 and #3 202.

TABLE 1

| | #1 | OIL | #2 | OIL | #3 | OIL | #4 |
|---|---|---|---|---|---|---|---|
| Compressor | X | TO 1, 4 | X | <<INTO>> | X | TO 1, 4 | X |
| | ○ | TO 4 | X | <<INTO>> | X | TO 4 | X |
| | X | | ○ | INTO>> | X | TO 1, 4 | X |
| | X | TO 1, 4 | X | <<INTO | ○ | | X |
| | X | TO 1, 4 | X | <<INTO>> | X | TO 1 | ○ |
| | ○ | | ○ | INTO>> | X | TO 4 | X |
| | X | TO 1, 4 OR INTO 1 | ○ | IF <<INTO>> | ○ | TO 1, 4 OR INTO 4 | X |
| | ○ | | X | <<INTO>> | X | | ○ |

X = Running
○ = Not Running

As can be seen from Table 1, most of the returned oil flows into compressors #2 and #3 202 when both of these compressors 202 are running, or to one of compressors #2 and #3 202 when one of the compressors 202 is running and the other is off. Both compressors #2 and #3 202 distribute oil to compressors #1 and #4 202 when these compressors 202 are running. When neither compressors #2 nor #3 202 is running, oil may still be returned to the non-running compressors 202 to be distributed to compressors #1 and #4

202 if they are running. In an alternate embodiment, when neither compressors #2 nor #3 202 is running, oil may be returned directly to compressors #1 and #4 202.

Figure 9:
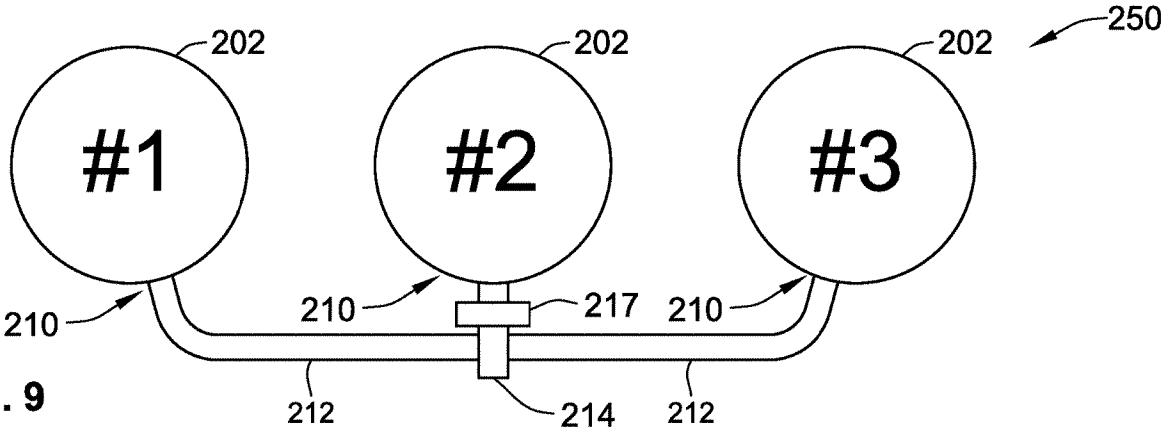
FIG. 9 is a schematic diagram of a three-compressor refrigeration system, according to an alternate embodiment of the invention.

FIG. 9 is a schematic diagram illustrating a three-compressor refrigeration system 250, according to an embodiment of the invention. Though not shown in FIG. 9, certain embodiments are configured to receive refrigerant and oil using the common supply line 204 and input supply lines 208, and may include a common discharge line 205, as shown and described in previous embodiments. In the embodiment of FIG. 9, compressor #2 202 has oil sump extension 214 attached at opening 210. The oil sump extension 214 provides connections for conduits 212 to compressors #1 and #3 202. Using the oil sump extension 214 makes it possible to construct each compressor 202 with only one oil port or opening 210, simplifying the manufacture and assembly of the refrigeration systems. Because the oil sump extension 214 has at least two connections, refrigeration system 250 still has two separate connections between the first pair of compressors #1 and #2 202, and the second pair of compressors #2 and #3 202.

Figure 12:
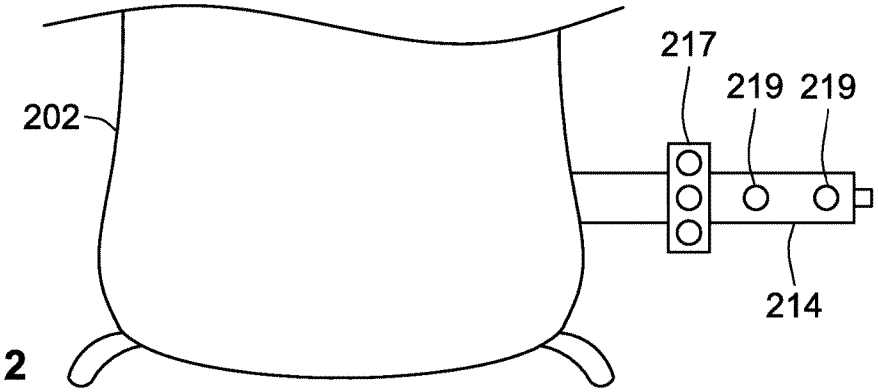
FIG. 12 shows a side view of compressor with an oil sump extension having a sight glass fitting and connections for conduits, in accordance with an embodiment of the invention.

Instead of having two openings 210 with two fittings on one or more compressors, the oil sump extension 214 may be fabricated by attaching a short section of pipe or similar device to, for example, the existing sight glass fitting 217. This allows all compressors 202 to be of the same configuration without the added cost of extra openings 210 or oil fittings. As will be shown below, it may be possible to have multiple compressors 202 connected to one oil sump extension 214 or to have multiple oil sump extensions 214 where needed. FIG. 12 shows a side view of compressor 202 with the oil sump extension 214 with sight glass fitting 217 and two connections 219 for conduits 212.

In particular embodiments, the oil sump extension 214 holds a volume of oil, relatively smaller than the oil in the oil sump of the compressor 202. The volume of oil held in the oil sump extension 214 is referred to herein as an "external oil sump" as opposed to the internal oil sump within the compressor housing. In a particular embodiment, a sight glass fitting 217 is located on the oil sump extension 214 to allow the user to visually check the oil level in the compressor 202. In a particular embodiment, most of the oil returned by the system is provided to compressor #2 202, which distributes the oil, as needed, to compressors #1 and #3 202. Generally, the compressors 202 only require oil when they are running.

Figure 10:
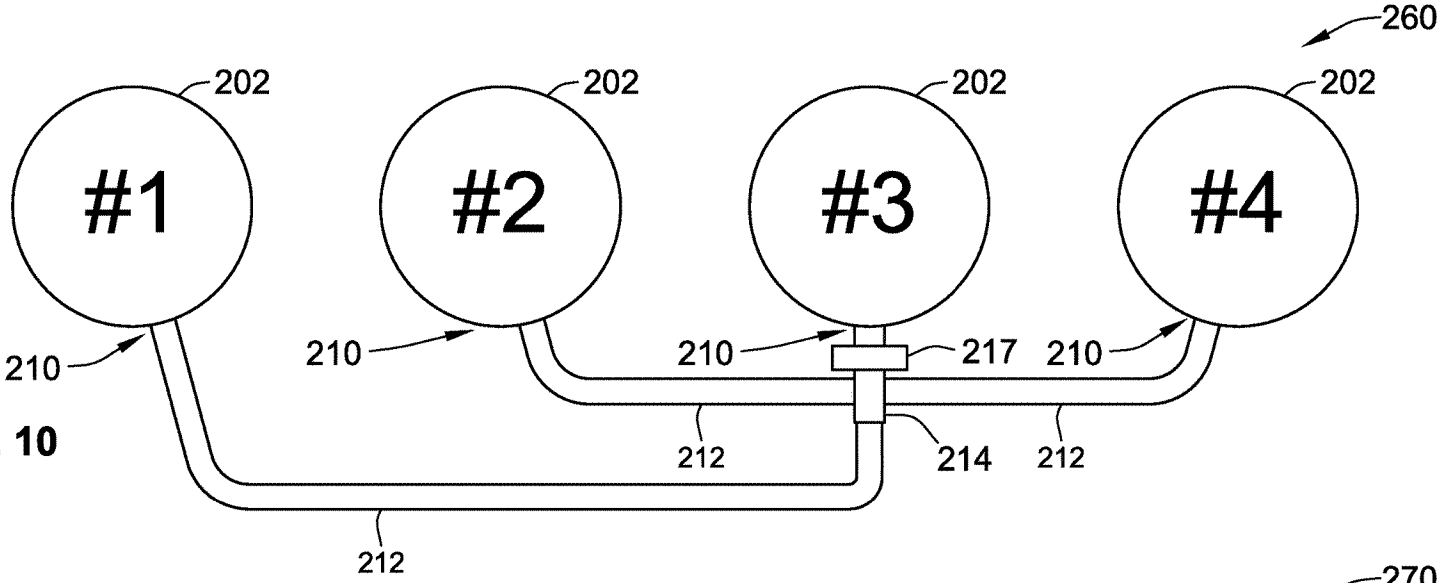
FIG. 10 is a schematic diagram of a four-compressor refrigeration system, constructed in accordance with yet another embodiment of the invention.

FIG. 10 is a schematic diagram illustrating a multi-compressor refrigeration system 260 arranged similarly to the refrigeration system 250 of FIG. 9, except that refrigeration system 260 has four compressors 202. Though not shown in FIG. 10, certain embodiments are configured to receive refrigerant and oil using the common supply line 204 and input supply lines 208, and may include a common discharge line 205, as shown and described in previous embodiments. In FIG. 10, the oil sump extension 214 is attached to compressor #3 202 at opening 210. As in the embodiment of FIG. 9, all of the compressors 202 only require a single opening 210. However, the oil sump extension 214 shown in FIG. 10 has connections for three conduits 212 to compressors #1, #2 and #4 202. This embodiment includes three separate connections in which compressor #3 202 is paired with each of the remaining three compressors 202.

Figure 11:
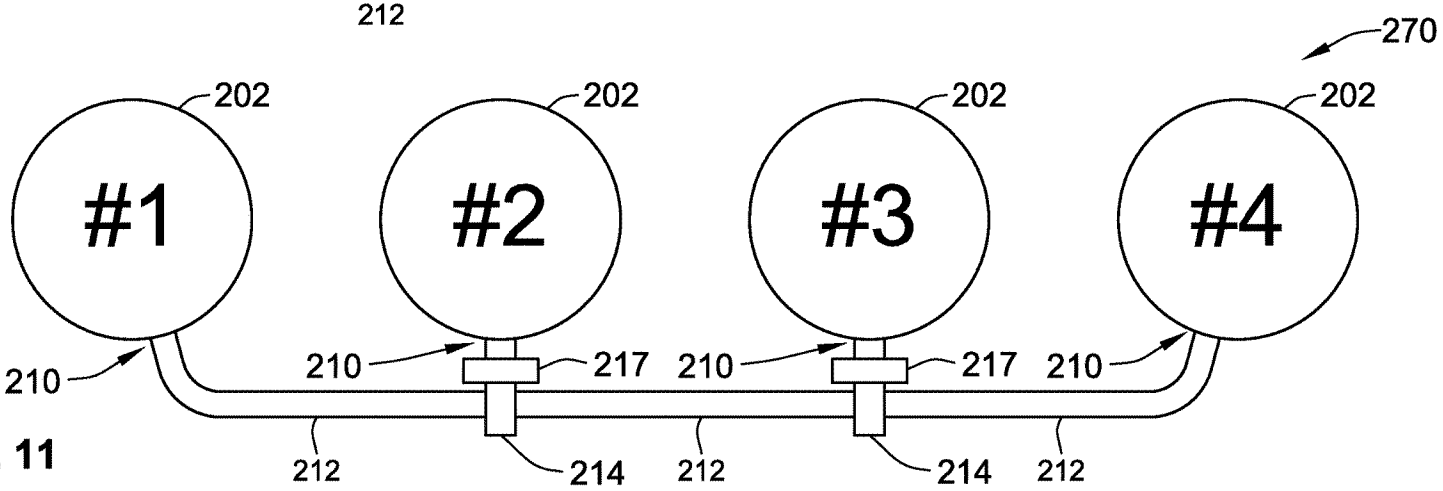
FIG. 11 is a schematic diagram of yet another four-compressor refrigeration system, constructed in accordance with an embodiment of the invention.

FIG. 11 is a schematic diagram illustrating a multi-compressor refrigeration system 270 arranged similarly to the refrigeration system 260 of FIG. 10, except that two compressors #2 and #3 202 in refrigeration system 270 have oil sump extensions 214. Though not shown in FIG. 11, certain embodiments are configured to receive refrigerant and oil using the common supply line 204 and input supply lines 208, and may include a common discharge line 205, as shown and described in previous embodiments. In FIG. 11, the two oil sump extensions 214 are attached to compressors #2 and #3 202 at their respective openings 210. Three separate conduits 212 provide separate connections between a first pair of compressors #1 and #2 202, a second pair of compressors #2 and #3 202, and a third pair of compressors #3 and #4 202.

The embodiments of the invention described above, eliminate the prevention of successful oil equalization in systems with three or more compressors 202 when one or more compressors 202 are off, that is, not operating. When a compressor 202 is off, the suction and oil sump pressures will be higher than that of running compressors 202. This typically causes gas to flow in the conduit 212, which constitutes an oil equalization line to the running compressors 202. However, the flow of gas and consequent slightly higher pressure in the equalization line 212 may prevent oil from leaving a running compressor 202, in which it may have accumulated from oil circulated in the system, and from being returned to the compressor 202 via suction gas flow. Embodiments of the invention allow for the flow of oil only from one compressor 202 to another rather than to multiple compressors 202 through a common equalization line 212, thus permitting oil to flow from a running compressor 202, for example, with a higher oil level than a compressor 202 that is not running.

The configurations shown in FIGS. 6-11 and described herein are designed to have oil (and gas when oil level is lower than equalization line) flow from one compressor 202 to another through a conduit 212, or oil equalization line, that communicates only with two of the compressors 202 in the multiple compressor system. Thus, flow cannot bypass a compressor, which can prevent flow from exiting that particular compressor. In a three-compressor system with suction configuration designed to return most of the oil to the center compressor #2 202, for example, there would be individual conduits 212, or oil equalization lines, to compressor #1 202 and to compressor #3 202. Thus, when compressor #3 202 is off, its higher pressure will flow only to compressor #2 202, and if compressor #2 202 is collecting oil, it can than move oil to compressor #1 202 to prevent it from losing oil from its sump.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of operating a refrigeration system having at least three compressors, each compressor having an oil sump with oil at an oil level, the method comprising:

supplying oil to all of the at least three compressors in any operating mode;

separately connecting the oil sumps of the at least three compressors, wherein each separate connection allows oil flow only between the oil sumps of two of said compressors thereby preventing flow from bypassing any of the at least three compressors; and flowing oil between oil sumps of the at least three compressors and along the separate connections so as to equalize the oil levels among the oil sumps of the at least three compressors.

2. The method of claim 1, wherein the separate connections between the oil sumps of the at least three compressors are located at approximately the same vertical elevation, which is equal to, or higher than, the oil level of oil to thereby promote equalization of oil levels among the oil sumps.

3. The method of claim 2, wherein separately connecting the oil sumps of the at least three compressors comprises connecting the oil sump of each compressor in a first group of the at least three compressors, each compressor in the first group having at least two separate connections, to oil sumps of compressors other than the first group of the at least three compressors.

4. The method of claim 3, wherein separately connecting the oil sumps of the at least three compressors comprises connecting the oil sump of each compressor in a second group of the at least three compressors to the oil sump of one compressor in the first group, each compressor in the second group having only a single separate connection.

5. The method of claim 3, wherein all of the at least three compressors have at least two separate connections.

6. The method of claim 3, further comprising:

extending the oil sump of at least one of the compressors of the first group with an oil sump extension to provide an internal oil sump, contained within a housing shell of the at least one of the compressors of the first group, and an external oil sump situated outside of the housing shell, wherein the oil sump extension has at least two separate connection ports to provide for said at least two separate connections.

7. The method of claim 3, wherein separately connecting the oil sumps of the at least three compressors comprises connecting the oil sump of each compressor of a second group of the at least three compressors to the oil sump of a compressor of the first group, each compressor in the second group having only a single separate connection;

wherein only one compressor is provided in the first group that is connected separately to each compressor of the second group.

8. The method of claim 7, wherein the second group includes at least three compressors.

9. The method of claim 6, wherein said extending the oil sump with an oil sump extension is done for at least two compressors.

10. The method of claim 9, wherein each oil sump extension is coupled to two compressors other than the compressor to which the oil sump extension is attached.

11. The method of claim 6, further comprising:

providing a sight glass fitting to provide a visual indication of the oil level, the sight glass fitting integral with the oil sump extension.

12. The method of claim 3, wherein each compressor of the first group has a housing shell, the housing shell having at least two separate oil sump ports having separate fittings connected thereto to provide the at least two separate connections.

13. The method of claim 1, wherein supplying oil to all of the at least three compressors comprises providing a common supply line configured to supply refrigerant and oil to the at least three compressors.

14. The method of claim 1, wherein supplying oil to all of the at least three compressors in any operating mode comprises supplying more oil to a same one of the at least three compressors than to any of the remaining compressors.

* * * * *